US006976676B2

(12) United States Patent
Adams

(10) Patent No.: US 6,976,676 B2
(45) Date of Patent: Dec. 20, 2005

(54) GAME APPARATUS

(76) Inventor: Troy E. Adams, 61 Prestwick Green, Daufuskie Island, SC (US) 29915

( * ) Notice: Subject to any disclaimer, the term of this patent is extended or adjusted under 35 U.S.C. 154(b) by 23 days.

(21) Appl. No.: 10/841,346

(22) Filed: May 10, 2004

(65) Prior Publication Data

US 2005/0248086 A1 Nov. 10, 2005

(51) Int. Cl.[7] ..... A63F 9/00

(52) U.S. Cl. ..... 273/138.1; 273/142 H; 70/306; 70/307

(58) Field of Search ..... 273/138.1, 107, 273/232, 142 AA, 142 H; 70/307, 306

(56) References Cited

U.S. PATENT DOCUMENTS

| | | | | |
|---|---|---|---|---|
| 241,691 | A * | 5/1881 | Mix | 70/437 |
| 1,524,598 | A * | 1/1925 | Moyer | 273/441 |
| 2,245,156 | A | 6/1941 | Peter et al. | |
| 3,531,114 | A | 9/1970 | Parks et al. | |
| 3,610,628 | A | 10/1971 | Promin | |
| 3,825,265 | A | 7/1974 | Pitkanen et al. | |
| 3,982,764 | A | 9/1976 | Dieball | |
| 4,095,795 | A * | 6/1978 | Saxton et al. | 463/20 |
| 4,152,867 | A * | 5/1979 | Ogawa | 446/445 |
| 4,333,237 | A * | 6/1982 | Carbone | 33/501 |
| 4,340,373 | A * | 7/1982 | D'Andrade et al. | 434/174 |
| 4,458,899 | A | 7/1984 | Kanno et al. | |
| 4,508,352 | A * | 4/1985 | Johnson | 273/274 |
| 4,542,688 | A | 9/1985 | Bohan | |
| 4,767,117 | A * | 8/1988 | Maio | 273/352 |
| 4,865,324 | A * | 9/1989 | Nesis | 273/155 |
| 4,902,230 | A * | 2/1990 | Jones | 434/206 |
| 5,106,091 | A * | 4/1992 | Comito | 463/22 |
| 5,221,093 | A | 6/1993 | Adams | |
| D342,547 | S * | 12/1993 | Putman et al. | D19/64 |
| 5,553,851 | A * | 9/1996 | Malavazos et al. | 273/142 E |
| 5,574,268 | A * | 11/1996 | Herman et al. | 235/91 R |
| 5,601,385 | A * | 2/1997 | Towers et al. | 408/3 |
| 5,636,838 | A * | 6/1997 | Caro | 273/142 E |
| 5,749,576 | A * | 5/1998 | Heinen et al. | 273/138.1 |
| 5,839,955 | A * | 11/1998 | Mangano et al. | 463/16 |
| D404,084 | S * | 1/1999 | Hedrick et al. | D21/370 |
| 6,047,965 | A * | 4/2000 | Mollo et al. | 273/142 E |
| 6,095,818 | A * | 8/2000 | Brazley | 434/173 |
| 6,105,962 | A * | 8/2000 | Malavazos et al. | 273/143 R |
| 6,129,355 | A * | 10/2000 | Hahn et al. | 273/142 R |
| 6,209,869 | B1 * | 4/2001 | Mathews | 273/138.1 |
| 6,497,409 | B2 * | 12/2002 | Mathews | 273/142 E |
| 6,561,512 | B2 * | 5/2003 | Luciano et al. | 273/142 HA |
| 6,598,877 | B1 * | 7/2003 | Luciano et al. | 273/142 R |
| 6,705,944 | B2 * | 3/2004 | Luciano | 463/20 |
| 6,802,507 | B2 * | 10/2004 | Inoue | 273/143 R |
| 6,877,345 | B1 * | 4/2005 | Misner et al. | 70/25 |
| 6,899,625 | B2 * | 5/2005 | Luciano et al. | 463/25 |

* cited by examiner

*Primary Examiner*—Stephen Blau
*Assistant Examiner*—Dolores R. Collins
(74) *Attorney, Agent, or Firm*—William M. Hobby, III

(57) ABSTRACT

The present invention relates to a game apparatus and especially to a combination game apparatus in which players try to guess a preset combination of digits.

19 Claims, 6 Drawing Sheets

GAME APPARATUS

BACKGROUND OF THE INVENTION

The present invention relates to a game apparatus and especially to a combination game apparatus in which players try to guess a preset combination of digits.

In the past, a wide variety of games including guessing games have been provided and these include many types of apparatus for playing games. Typically board games have spinning wheels or dice and the like and typically use cards and have various rules for playing the games. There are also many electronic type games which use computer circuitry including microprocessors and stored memory to play a game on a CRT using joysticks or controls. These type of games are typically used in arcades and may include coin boxes and the like.

The present game relates to a combination game in which each player guesses the digits of a combination and, if all of the digits selected form the proper combination, either a door is opened or some other indication is given indicating the correct combination. Other prior art U.S. patents showing guessing games or games using ball and tracks can be seen in the Peter et al. U.S. Pat. No. 2,245,156 for a game of skill which uses automatic delivery of coins through a passageway and enables the player to affect mechanical settings of the device to various modes of playing a game of roulette or the like. The Dieball U.S. Pat. No. 3,982,764 is an electrical game apparatus of chance which includes a housing and display board using a plurality of display lights arranged to provide random symbols or numerals or letters and which game includes a rotatable mixer switch for varying the operation of the display lights with respect to the corresponding 4 switches. The Promin U.S. Pat. No. 3,610,628 is for a game apparatus having a plurality of number ring assemblies mounted vertically and rotatably on a shaft and each number ring assembly has a hole therethrough so that the assemblies can be rotated to any predetermined position which determines whether the base is allowed to drop through one number ring assembly and out through a base to indicate a winner. The Pitkanen et al. U.S. Pat. No. 3,825,265 shows an amusement machine which has a vertically disposed playing surface such that perforated tokens or slugs are propelled upwards so as to descend into a plurality of slots or reservoirs. The Parks et al. U.S. Pat. No. 3,531,114 shows an electric matching game apparatus using a series of electrical switches such that if correct selections are made, an electrical circuit is completed for dispensing tokens. The Kanno et al. U.S. Pat. No. 4,458,899 is a game capable of collecting and then randomly dispensing objects. The Bohan U.S. Pat. No. 4,542,688 is a container disposal apparatus which raises containers to an elevated position from which they can traverse a downwardly inclined chute where a rotatable interpreter plate, positioned in the chute's path, allows the containers to traverse the interrupter plate to trigger a prize dispensing mechanism.

My prior U.S. Pat. No. 5,221,093 of Jun. 22, 1993 for a Game Apparatus utilizes a ball running through a selected path formed by the rotation of a plurality of chutes for the ball. The ball cannot pass down the chute to the next selected combination unless the first correct chute has been selected. The ball travels down a series of ball chutes, each one of which can be selected from one of a plurality of chutes and a wrong selection returns the ball without completing the full combination circuit and requires the player to start over. The game has means for changing the code each time a game is played such that the players cannot view or determine what the new combination is and then the game can be played by rotating dials which determine whether balls will traverse the ball tracks and chutes through the combination setting members to complete a circuit to give an indication of a successful setting of the combination.

The present invention is an improvement over my prior U.S. Patent and has means for changing the code each time a game is played by the rotation of several concentric wheels which align openings in each wheel to form pathways for a token or game member to traverse and which either completes the correct path to activate a latching mechanism to allow the opening of a door or, alternatively, is shunted from the incorrect path without unlatching the door.

SUMMARY OF THE INVENTION

A game apparatus has a game element and a housing having a game element input and output. A combination setting system for changing the combination of the game includes a plurality of concentric code wheels in which each code wheel has a plurality of openings therein sized for a game element to pass therethrough and a plurality of concentric indicia wheels. Each of the concentric indicia wheels may be removable attached to one code wheel in a plurality of positions aligning a plurality of code wheel openings between adjacent concentric wheels to form a plurality of selectable combination paths through said plurality of code wheels. The attached concentric code and indicia wheels are separately rotatably mounted in the housing. A plurality of the code wheel openings each has a diverter member therein for diverting a game element passing therethrough from the path between code wheel openings when a diverter member is positioned in any one of the concentric code wheel openings of a selected combination path. The attaching of each concentric code wheel with each concentric indicia wheel forms a combination pathway for the game element to pass through so that rotation of each of the attached indicia and code wheels is used to align the openings in the code wheels for guessing the code having the correct path for the game element to pass through. Each indicia wheel has a series of numerals thereon rotatable to different positions. Each indicia wheel has a plurality of openings therein and has an indicia element, such as a ball, removably positioned in the openings so that the indicia element is outputted from each of the selected openings upon attaching a code wheel to an indicia wheel. The housing has a latching hinged door which unlatches when the game element passes through the correct combination pathway. The door latch is attached to the housing and unlatches the hinge door when the game element falls on one end of a latching lever upon passing through the correct combination pathway. The one diverter member in the innermost concentric code wheel opening is mounted in a separate direction to the other diverter members in the concentric code wheel openings for directing the game element against the latching lever to actuate the door latch. Thus, each diverter member facing in one of two directions and each code wheel opening may or may not have a diverter member. A plurality of concentric code wheels and attached indicia wheels rotate around a center tube mounted to the housing and having the door latch mounted therein. The concentric code wheels and each concentric indicia wheel are each attached together by a plurality of pegs on one wheel pushing into openings in the other wheel while simultaneously driving a plurality of indicia elements from each indicia wheel.

The game is played by presetting each code wheel in one of its plurality of positions relative to its associated indicia wheel and connecting the wheels to form a plurality of pathways through each set of code wheels which simultaneously pushes out indicia elements from the indicia wheels. The attached code wheel and indicia wheels are then rotated to any of the indicated numerals on the indicia wheels to set up a combination which align three of the code wheel openings with an opening in the housing so that a game element or token can be dropped therein to follow through the pathway created by the code wheel openings. If the correct combination is selected, the game element falls upon the latching mechanism to unlatch the door. If the incorrect combination is selected, the game element is directed by one of the diverter elements in one of the openings in the code wheel to the inside and back of the center tube leaving the latch to the door in the locked position and then is directed through a slot in the tube to the bottom of the housing when the opening handle of the hinged door is turned.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
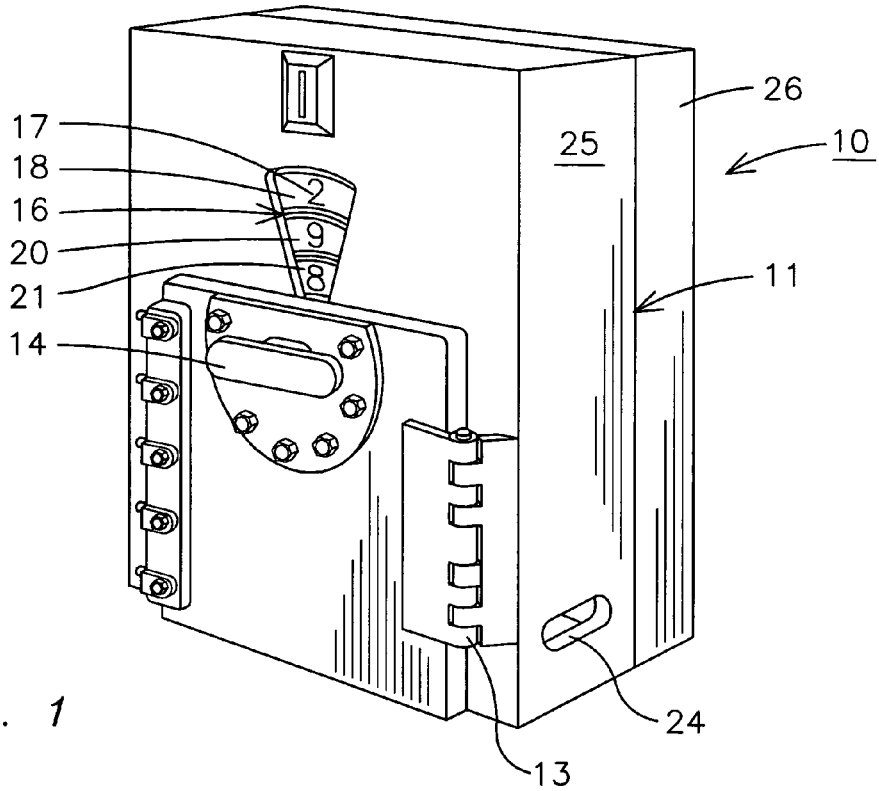
FIG. 1 is a front perspective view of a game apparatus in accordance with the present invention.
Figure 2:
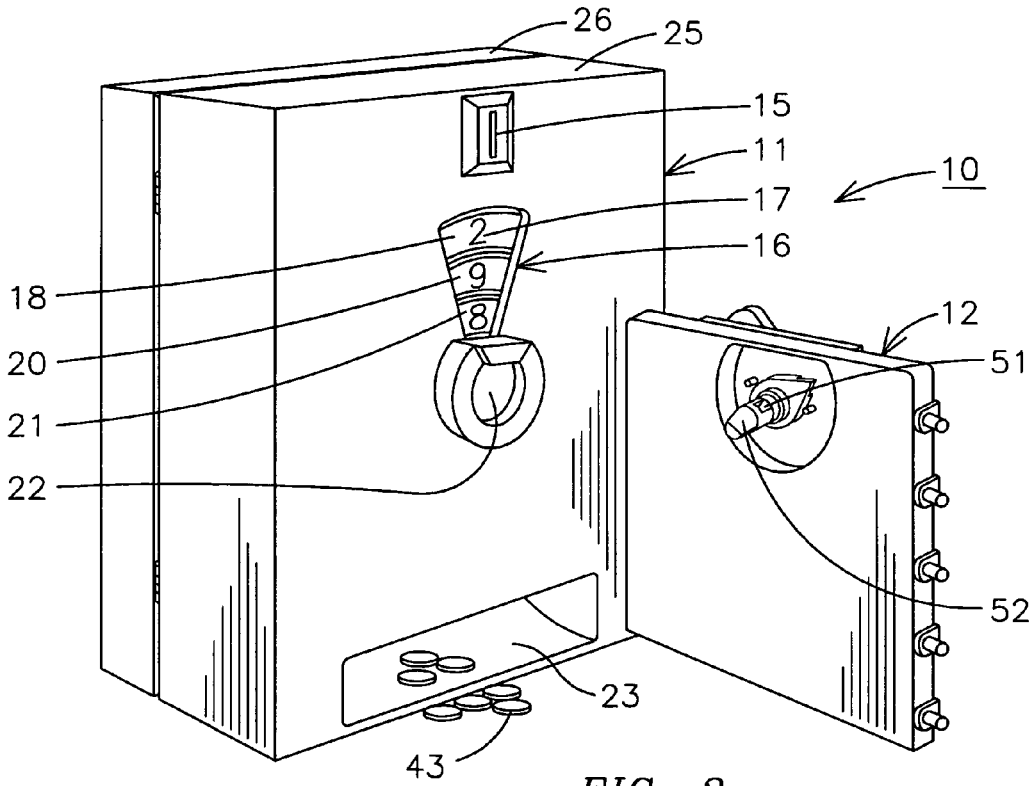
FIG. 2 is a front perspective view of the game of FIG. 1 having the locking door open.

Referring to the drawings and especially to FIGS. 1 and 2, a game apparatus 10 is illustrated having a housing 11 and a hinge door 12 hinged with the hinge 13 and includes an opening handle 14. A game element slot 15 is located at the top of the housing 11 and an open window 16 allows the indicia 17 of three indicia wheels 18, 20, and 21 to be seen from the front of the housing. In FIG. 2, the opening illustrates an opening 22 in the housing 11 when the door 12 is opened and a bottom opening 23 for recovering the game tokens. In addition, a side opening 24 allows the recovery of indicia element during the playing of the game.

Figure 3:
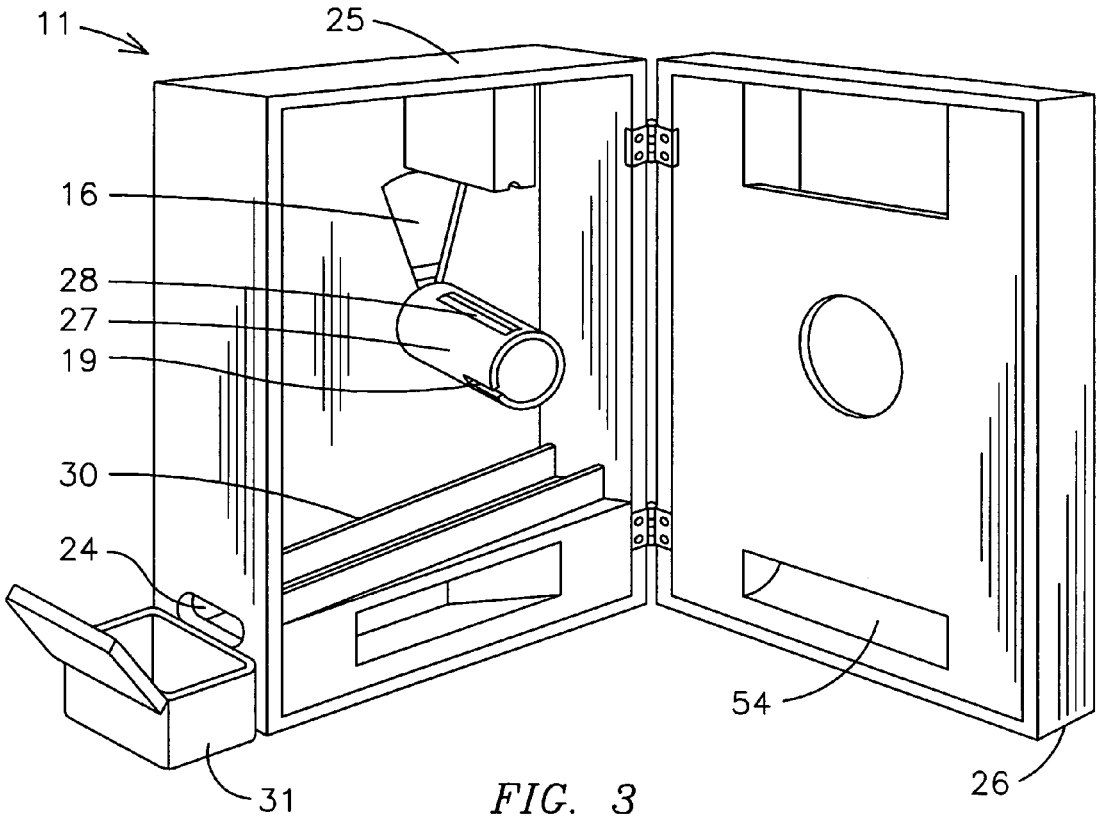
FIG. 3 is a rear perspective view of the housing of the game of FIGS. 1 and 2 having the rear door opened.

As seen in FIG. 3, the housing 11 has a front housing member 25 hinged to a rear housing member 26 and an axially mounted tube 27 mounted to the housing portion 25 just below the opening 16. Tube 27 has a slot 28 in the top thereof and a slot 19 in the bottom thereof. The bottom of the housing has a discharge chute 30 which discharges through the opening 24 into a container 31.

Figure 4:
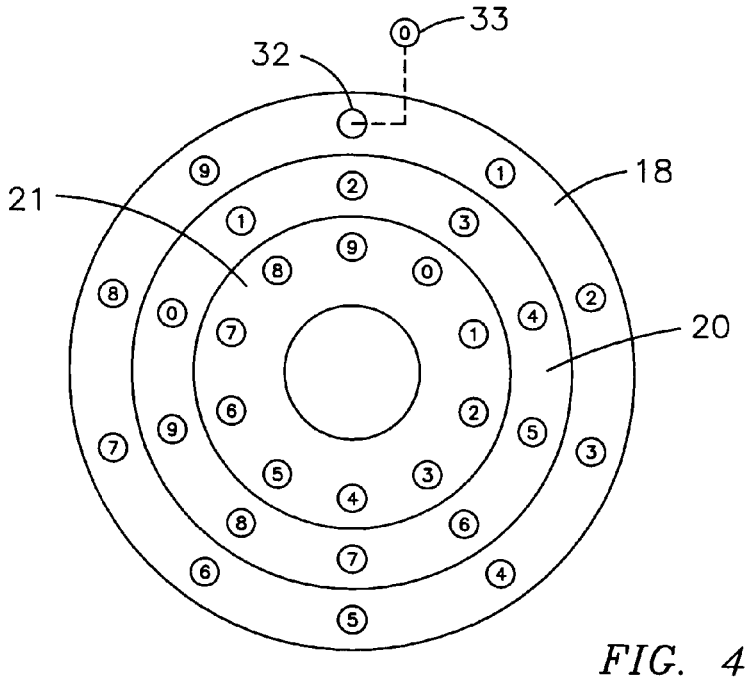
FIG. 4 is a rear elevation of three concentric indicia wheels.
Figure 5:
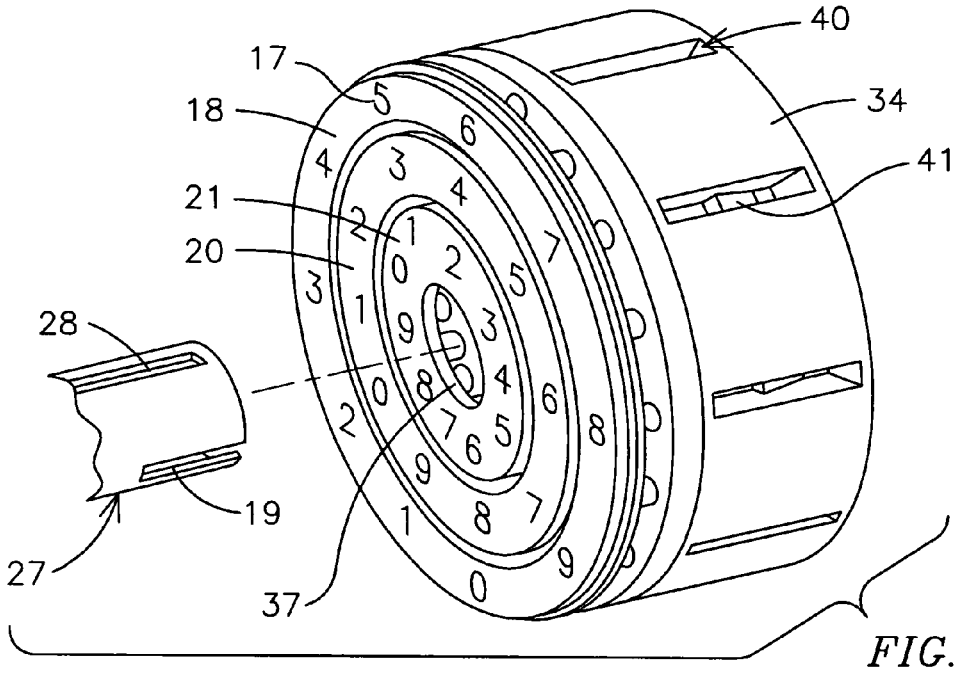
FIG. 5 is a perspective view of three wheel pairs exploded from the center support tube.

FIG. 4 illustrates the indicia wheels 18, 20 and 21, each having a plurality of openings 32 therein and each containing an indicia element 33, such as a ball having a numeral thereon. These indicia elements are selectively pushed from the indicia wheels 18, 20, and 21 upon connecting the concentric indicia wheels 18, 20 and 21 with matching concentric code wheels 34, 35, and 36. The centermost indicia wheel 21 and the matching code wheel 36 have a center axial opening 37 which allows the concentric wheels to be rotatably mounted on the tube 27, as seen in FIGS. 5 and 6.

Figure 6:
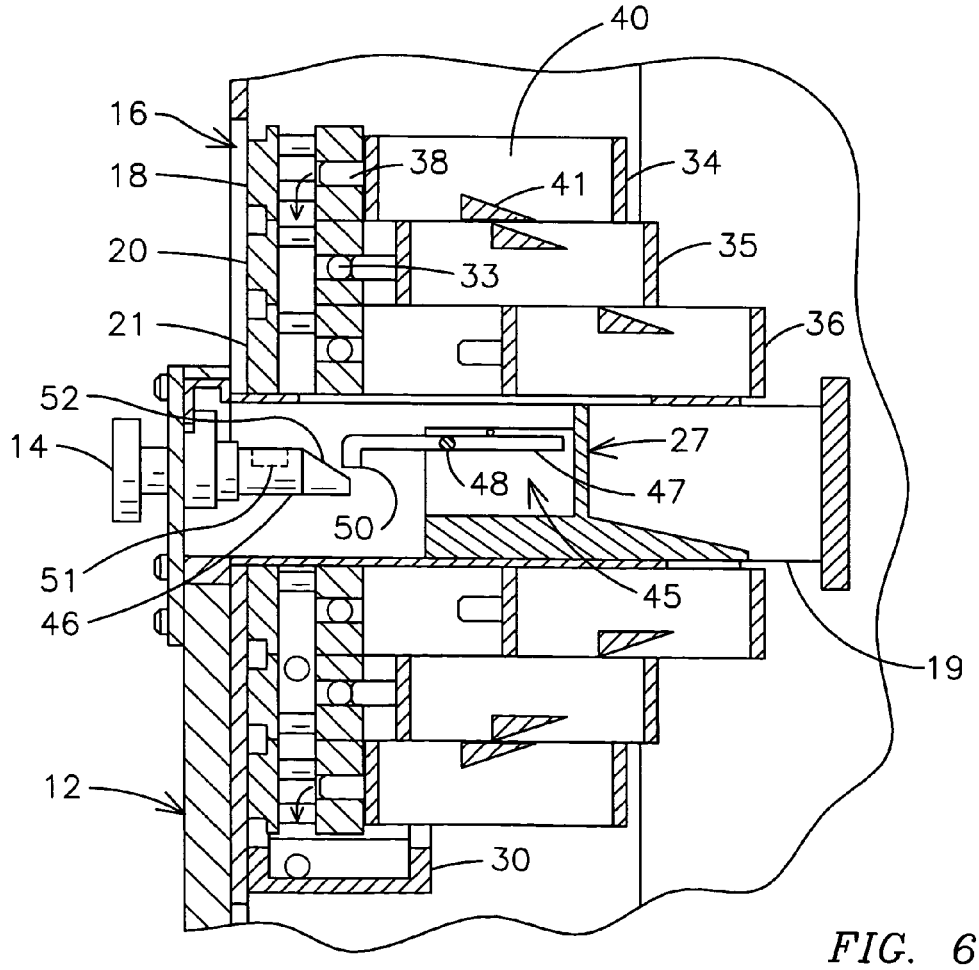
FIG. 6 is a sectional view taken through a portion of the game apparatus of FIG. 1 having the code wheels partially attached to the indicia wheels.
Figure 7:
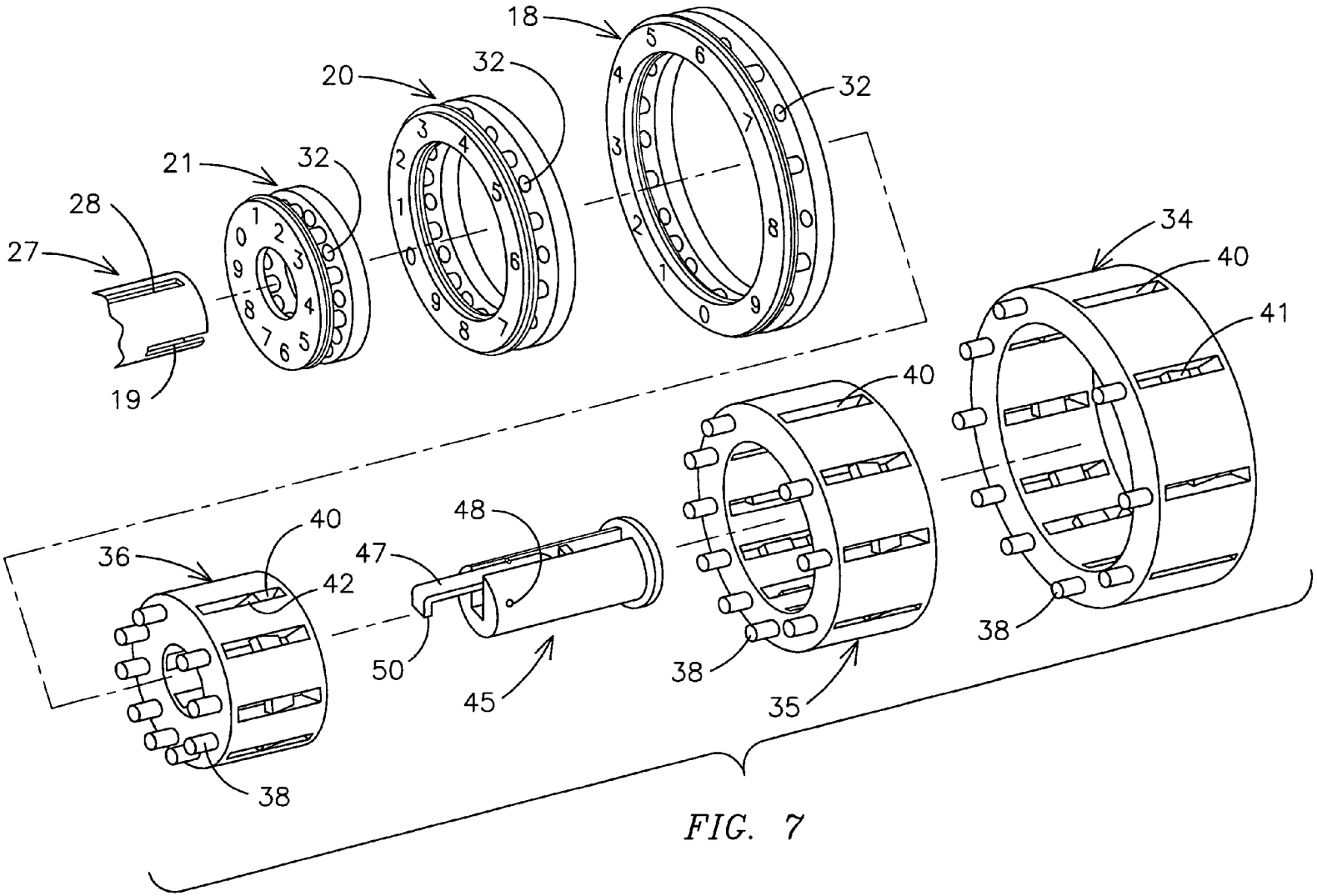
FIG. 7 is an exploded view of the code and indicia wheels mounted to the tube and latching mechanism for the combination game.

As seen in FIGS. 6 and 7, each indicia wheel 18, 20 and 21 has a plurality of openings 32 and each code wheel 34, 35 and 36 has a plurality of pegs or posts 38 mounted thereto. The holes 32 and the posts 38 are mounted around the respective wheels for inserting all of the pegs 38 into the openings 32 in any number of positions for holding the wheels together and for pushing the indicia elements 33 out of the indicia wheels and onto the chute 30 of FIG. 3 and into the container 31. These removed indicia elements are then used by the players as clues to the correct combination. Each code wheel 34, 35 and 36 has a plurality of openings 40 therein, each opening 40 being aligned with one of the numbers 17 on the front of the indicia wheels. Each of the code wheels 34 and 35 openings 40 have a diverter element 41 mounted in all the openings except one. Each of the code wheels 36 openings 40 have diverter elements, with one diverter element 42 facing the opposite direction than the others.

The code wheels 34 and 35 have one opening 40 that does not have a diverter element 41 therein so as to allow a game element or ball to fall through two openings 40 in the wheels 34 and 35 when they are aligned together. A third code wheel 36 has one opening 40 with a diverter element 42 facing in the opposite direction, as illustrated in FIG. 9, to direct the game element against the latching element 47 of the latching mechanism 45 when the correct combination has been set between three code wheels 34, 35 and 36.

Figure 8:
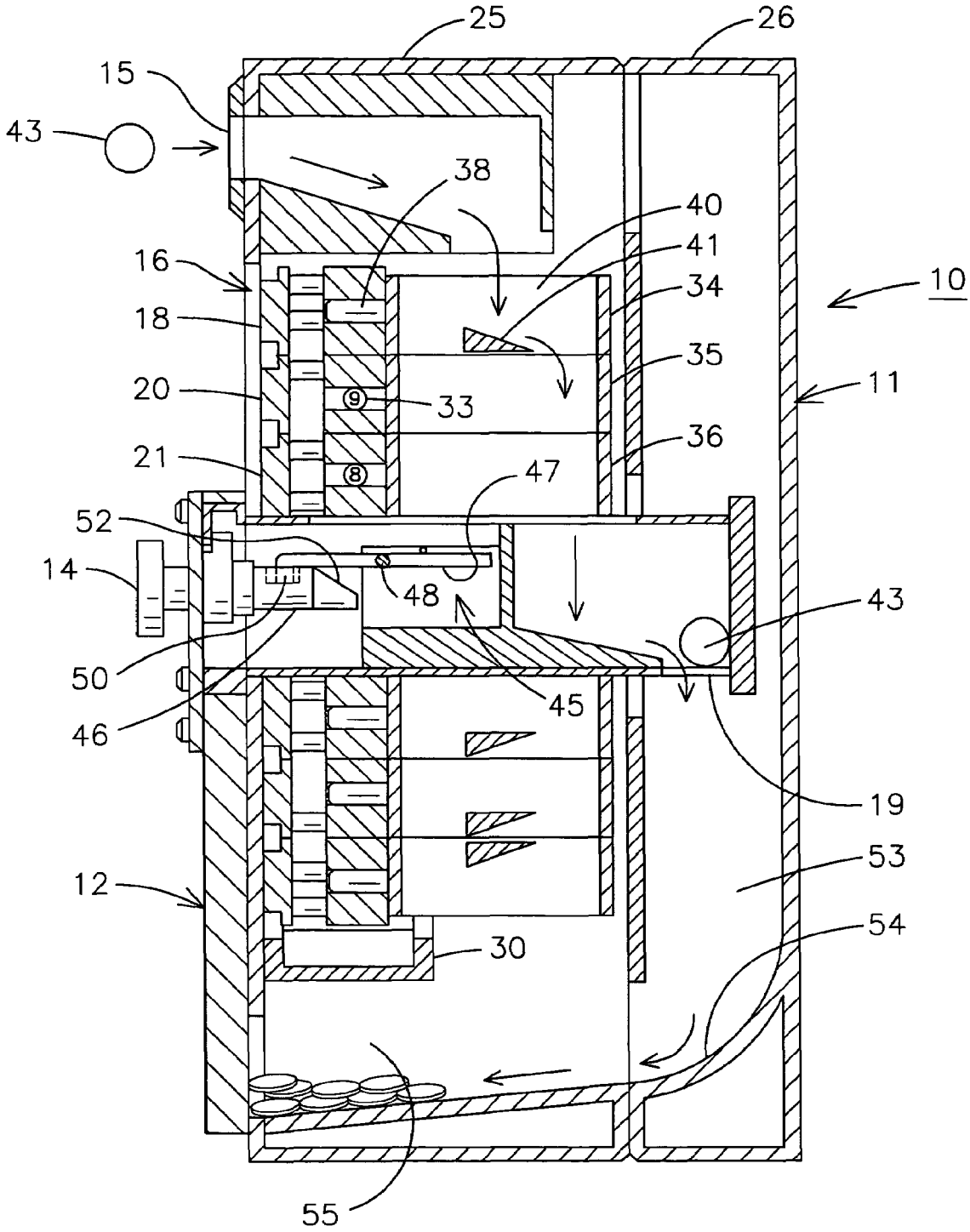
FIG. 8 is a sectional view taken through the combination game of FIG. 1 illustrating the movement of one game element for an incorrect combination.
Figure 9:
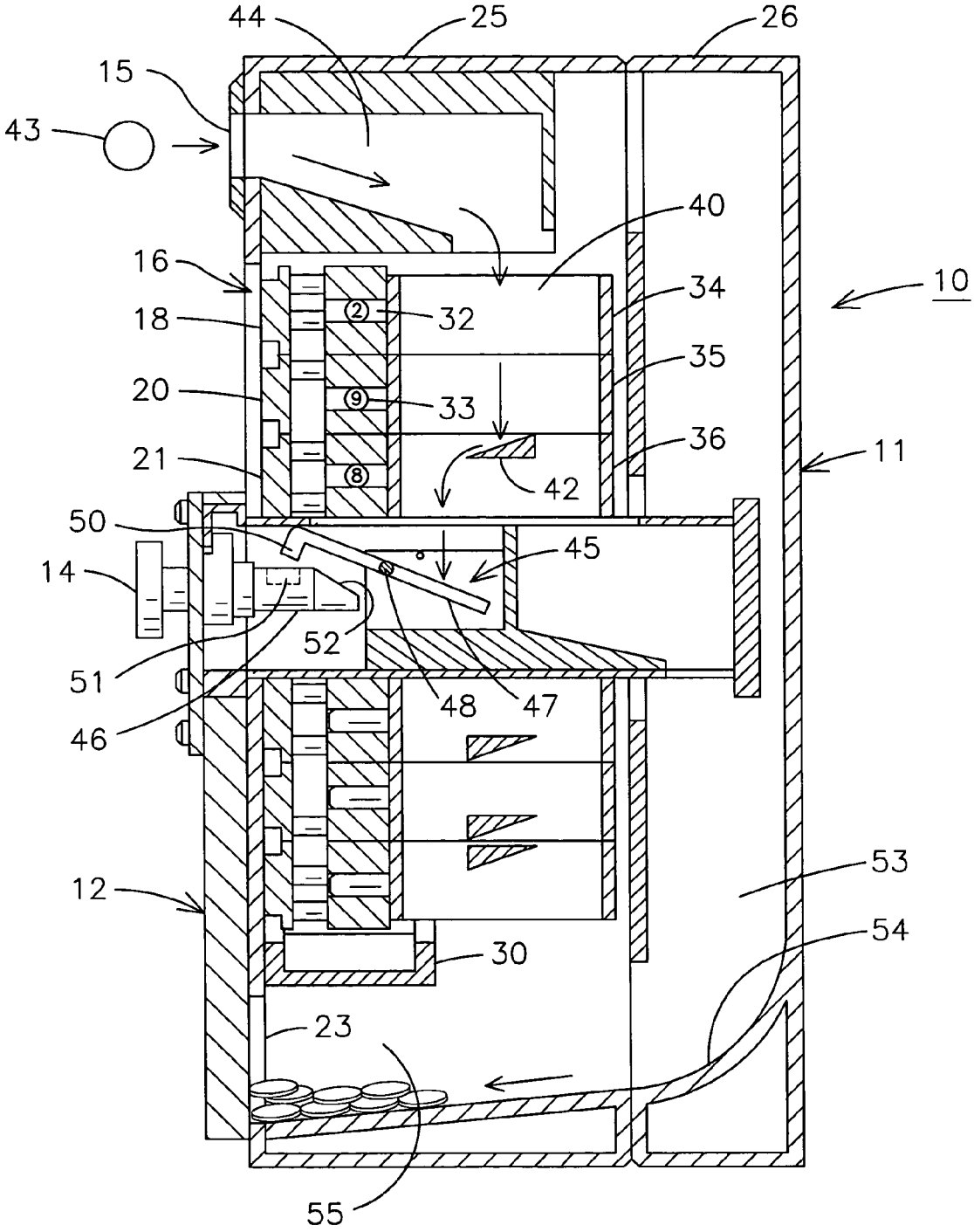
FIG. 9 is a sectional view in accordance with FIG. 8 illustrating one game element passing through the correct combination pathway.

In FIGS. 8 and 9, a game element 43 is inserted through the slot 15 in FIG. 9 when the correct combination has been selected and in FIG. 8 when the incorrect combination is set. The game element 43 in FIG. 9 passes through a pathway 44 which passes through openings 40 having no diverter elements 41 therein and thus passes through both code wheels 34 and 35 and hits the diverter element 42 in code wheel 36 which directs the element against the latching mechanism 45. The latching mechanism 45 is attached by sliding it inside the center tube 27 and has a latch element 47 rotatably held with pin 48 attached to the sides of the latching mechanism. A latching catch member 50 on the end of lever 47 is forced by gravity into the shaft 46 slot 51 having the angled lift surface 52 on the end thereof. Thus, when the game element 43 falls against the lever arm 47, it lifts the latch member 50 from behind the stop 52 to allow the door 12 to be opened.

In FIG. 8, however, the game element 43 passes into the opening 40 in the code wheel 34 and hits a diverter element 41 of the wrong combination which dumps the game element to the back part of the tube 27. When the opening handle 14 is turned, the game element 43 goes down a passageway 53 onto an arcuate guide 54 where it collects into the bottom of the housing 55. Every time a wrong combination is selected from the rotated and aligned code wheels 34, 35 and 36, a game element 43 is directed through the passageway 53 and into the holding area 55 and can be collected whenever the right combination is hit upon which allows the opening of the door 12, as seen in FIG. 2, so that the game elements can be recovered through the opening 23.

The exploded view in FIG. 7 shows the assembly of the concentric code wheels 34, 35 and 36 with the concentric indicia wheels 18, 20 and 21 and the latch mechanism 45 which is slid into the center tube 27 and the attached code and indicia wheels can individually rotate around the center tube 27 to allow the setting of different codes. Each of the code wheels 34 and 35 can be seen having one opening 40 having no diverting element therein and code wheel 36 can be seen having one opening 40 with a diverter element 42 facing the opposite direction than the other diverter elements 41. Rotating each of these code wheels 34, 35, and 36 relative to the indicia wheels 18, 20 and 21 attaches the wheels together by pushing the pegs 38 into the openings 32 of its associated indicia wheel.

Simultaneously, the pegs 38 will drive the indicia elements or clues from the openings 32 when they are pushed into the openings 32 except for the opening not having a diverter element in 34 and 35 which has no respective peg 38 and thereby leaves the element within the opening 32 in the indicia wheel. Similarly, the opening 40 in the indicia wheel 36 having the diverter element 42 facing the opposite direction has no equivalent peg 38. The combination requires the aligning of the openings 40 with no diverter element in wheels 34 and 35 with the diverter 42 in the opening 40 in wheel 36 which faces in the opposite direction to form a correct pathway and combination for opening the latch 47 and allowing the opening of the door 12.

It should be clear at this time that a combination game which allows players to preset the combination of three concentrically mounted wheels by the connection of a code wheel to an indica wheel has been taught and which is provided with indicia elements or clues. However, the game should not be considered as limited to the elements as shown which are to be considered illustrative rather than restrictive.

I claim:

1. A game apparatus comprising:

a game element;

a housing having a game element input and output;

combination setting means for changing the combination in the game, said combination setting means having a plurality of concentric code wheels, each said concentric code wheel having a plurality of openings therein sized for said game element to pass therethrough, and a plurality of concentric indicia wheels, each said concentric indicia wheel being removably attachable to one said code wheel in a plurality of positions aligning said plurality of said code wheel openings between adjacent concentric code wheels to form a plurality of selectable combination paths through said plurality of code wheels and said attached concentric code and indicia wheels being separately rotatably mounted in said housing, and a plurality of said code wheel openings having a diverter member therein for diverting a game element passing therethrough from said path between code wheel openings when a diverter member is positioned in anyone of said concentric code wheel openings of a selected combination path whereby the attaching of each concentric code wheel with each concentric indicia wheel forms a combination pathway for said game element to pass through so that rotation of each of said attached indicia and code wheel is used to align the opening in said code wheels for guessing the code having the correct path for said game element to pass through.

2. A game apparatus in accordance with claim 1 in which said indicia wheels each has a series of numerals thereon rotatable to different positions.

3. A game apparatus in accordance with claim 2 in which each indicia wheel has a plurality of openings therein and has an indicia element removably positioned in each said openings which indicia element is outputted from each of selected holes by upon attaching said code wheel to said indicia wheel.

4. A game apparatus in accordance with claim 3 in which each said indicia element is a ball having indicia thereon.

5. A game apparatus in accordance with claim 4 in which said housing has a latching hinged door which unlatches when said game element passes through said correct combination pathway.

6. A game apparatus in accordance with claim 5 in which said game element falls on one end of a latching lever to unlatch said hinged door when said game element passes through said correct combination pathway.

7. A game apparatus in accordance with claim 6 in which at least one said diverter member in one said concentric code wheel opening is mounted in a second direction to the other said diverter members in said concentric code wheel openings for directing said game element onto a latching lever to actuate a latching door.

8. A game apparatus in accordance with claim 7 in which each said game element is a token.

9. A game apparatus in accordance with claim 8 in which each said diverter member is a chute facing in one of two directions.

10. A game apparatus in accordance with claim 9 in which each of said plurality of concentric code wheels and attached indicia wheels rotate around a center tube mounted to said housing and having said door latch mounted therein.

11. A game apparatus comprising:

a game element;

a housing having a game element input and output;

combination setting means for changing the combination in the game, said combination setting means having a plurality of first concentric wheels, each first wheel having a plurality of posts extending therefrom and a plurality of second concentric wheels, each second wheel having a plurality of bores extending thereinto and positioned for alignment with one of said first wheel posts, whereby each of said plurality of posts of one said first wheel can slide into one of said plurality of bores of one said second wheel in a plurality of positions to form a plurality of attached wheel pairs, and each of said plurality of wheel pairs having a plurality of openings therein sized for a game element to pass through and a plurality of each said wheel pair openings having a game element guide member positioned therein to form a plurality of pathways through said plurality of pairs of concentric wheels by the presence or absence of a game element in an opening in said pair of wheels when said plurality of pair of wheels openings are aligned with each other for said game member to pass therethrough, at least one of said plurality of pathways forming the correct combination for said game and each pair of wheels being concentrically and rotatably mounted in said housing with one pair of said wheels having the opening therein alignable with said housing input whereby a game combination can be determined by the positioning of each wheel of a wheel pair being positioned relative to the other wheel of said wheel pair and said pair of game wheels can be rotated to find the set combination.

12. A game apparatus in accordance with claim 11 in which each second wheel of each pair of wheels has an indicia element positionable in one said hole therein which is outputted from said hole by one said first wheel post.

13. A game apparatus in accordance with claim 12 in which each indicia element is a ball having indicia thereon.

14. A game apparatus in accordance with claim 13 in which said housing has a latching hinged door which unlatches when said game element passes through said correct combination pathway.

15. A game apparatus in accordance with claim 14 in which said game element falls on one end of a latching lever to unlatch said hinged door when said game element passes through said correct combination pathway.

16. A game apparatus in accordance with claim 15 in which at least one said game element guide member in one said concentrically mounted pair of wheels is mounted in a second direction to the other guide members for directing said game element onto said latching lever to actuate said latching door.

17. A game apparatus in accordance with claim 16 in which said game element guide member is a chute facing in one of two directions.

18. A game apparatus in accordance with claim 17 in which a discharge chute is located in the bottom of said housing for discharging each said indicia element out an opening in said housing.

19. A game apparatus in accordance with claim 18 in which said plurality of concentric pairs of wheels rotate around a center tube mounted to said housing and having said door latch mounted therein.

* * * * *